US006801741B2

(12) United States Patent
Enomoto et al.

(10) Patent No.: US 6,801,741 B2
(45) Date of Patent: Oct. 5, 2004

(54) IMAGE FORMING APPARATUS WITH INTERMEDIARY TRANSFER MEMBER

(75) Inventors: Naoki Enomoto, Susono (JP); Akihiko Takeuchi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/327,167

(22) Filed: Jun. 7, 1999

(65) Prior Publication Data

US 2003/0007810 A1 Jan. 9, 2003

(30) Foreign Application Priority Data

Jun. 5, 1998 (JP) ..... 9-158202

(51) Int. Cl.[7] ..... G03G 15/16
(52) U.S. Cl. ..... 399/302; 399/308
(58) Field of Search ..... 399/302, 308, 399/303; 430/46, 47, 48

(56) References Cited

U.S. PATENT DOCUMENTS

| | | | | |
|---|---|---|---|---|
| 5,153,654 A | | 10/1992 | Yuminamochi et al. | 355/277 |
| 5,196,885 A | | 3/1993 | Takeuchi et al. | 355/219 |
| 5,223,900 A | | 6/1993 | Yuminamochi et al. | 355/273 |
| 5,523,829 A | | 6/1996 | Miyashiro et al. | 355/271 |
| 5,623,330 A | * | 4/1997 | Ishibashi | 399/310 |
| 5,745,830 A | * | 4/1998 | Fujiwara et al. | 399/308 |
| 5,809,387 A | * | 9/1998 | Takeuchi et al. | 399/302 |
| 5,832,351 A | * | 11/1998 | Takekoshi et al. | 399/303 |
| 6,042,917 A | * | 3/2000 | Schlueter, Jr. et al. | 399/302 |

FOREIGN PATENT DOCUMENTS

| | | | |
|---|---|---|---|
| JP | 8-50419 | * | 2/1996 |
| JP | 8-220893 | * | 8/1996 |

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing means for bearing a toner image; an intermediary transfer member, wherein the toner image is electrostatically transferred from the image bearing means onto the intermediary transfer member, and then transferred from the intermediary transfer member onto a transfer material; wherein the intermediary transfer member includes a first layer and a second layer, provided on the first layer, for receiving the toner image from the image bearing means, and wherein the second layer has a volume resistivity smaller than that of the first layer.

59 Claims, 7 Drawing Sheets

IMAGE FORMING APPARATUS WITH INTERMEDIARY TRANSFER MEMBER

FIELD OF THE INVENTION AND RELATED ART

The present invention relates to an image forming apparatus, for example, a copying machine, a printer, a facsimile machine, in particular, an image forming apparatus which transfers a toner image on an image bearing member onto intermediary transfer medium, and transfers the image on intermediary transfer medium onto a piece of transfer medium.

There have been known various image formation systems for a color image forming apparatus, for example, a thermal transfer system, an ink jet system, and the like. Among these systems, an electrophotographic system is superior to the rest in terms of image formation speed, image quality, noise level, and the like aspects.

There are also various electrophotographic systems, for example, a multiple layer development system, a multiple layer transfer system, an intermediary transfer system, and the like. According to a multiple layer development system, a plurality of color images (plurality of toner images of different color) are formed in layers on the peripheral surface of a photosensitive member, and then, the plurality of toner images on the photosensitive member are transferred all at once onto a piece of transfer medium. According to a multiple layer transfer system, a plurality of toner images of different color are consecutively transferred onto a piece of transfer medium as each of them is formed. In comparison, according to an intermediary transfer system, a plurality of toner images of different color are consecutively transferred (first transfer) onto an intermediary transfer medium as each of them is formed, and then, the plurality of toner images of different color are transferred all at once (secondary transfer) onto a piece of transfer medium. Among these electrophotographic systems, an intermediary transfer system enjoys substantial advantages: for example, there is little possibility of color mixing, and various transfer media different in quality, thickness, or the like properties, can be used.

FIG. 9 is a schematic sectional view of an image forming apparatus (full color laser beam printer based on four primary colors) which uses one of the conventional intermediary transfer systems, and depicts the general structure of the image forming apparatus.

As depicted by the drawing, along the peripheral surface of the photosensitive drum 1, a charging apparatus 2, an exposing apparatus 3, a developing apparatus 5, an intermediary transfer belt 18, a photosensitive drum cleaner 16, and a discharge roller 17, are disposed in the rotational direction of the photosensitive drum 1 (direction R1 indicated by an arrow mark), in the listed order. The photosensitive drum 1 is an image bearing member, and the exposing apparatus 3 projects a laser beam L onto the peripheral surface of the photosensitive drum 1.

Here, the image forming process of this image forming apparatus will be briefly described.

First, the photosensitive drum 1 is uniformly charged by the charging apparatus 2, and an electrostatic latent image is formed on the peripheral surface of the photosensitive drum 1 by the laser beam L from the exposing apparatus 3. Each electrostatic latent image is developed by one of the developing devices in the developing apparatus 5: yellow color developing device 5*a*, cyan color developing device 5*b*, magenta color developing device 5*c*, and black color developing device 5*d*, and transferred (first transfer) onto the intermediary transfer belt 18, in a primary transfer station N1. As a result, a color image constituted of four toner images of different color is created.

The color image on the intermediary transfer belt 18 is transferred (secondary transfer) all at once onto a transfer medium P as a transfer roller 7 for the secondary transfer is pressed upon the intermediary transfer belt 18, with the transfer medium P being pinched between the roller 7 and belt 18. After the secondary transfer, the transfer medium P is conveyed to a fixing apparatus (unillustrated), in which the color image consisting of four toner images of different color is fixed to the surface of the transfer medium P by the application of heat and pressure. Thereafter, the transfer medium P is discharged from the image forming apparatus.

In the past, in order to prevent the problem that after a toner image is transferred onto the intermediary transfer belt 18, the toner particles are scattered from the toner image at the locations where the intermediary transfer belt 18 is bent (where rollers 8, 9, and 10 support intermediary transfer belt 18), the intermediary transfer belt 18 was provided with a surface layer with higher volumetric resistivity, located on the side onto which a toner image is transferred.

However, providing the intermediary transfer belt 18 with the surface layer with higher volumetric resistivity often triggered electrical discharge between the photosensitive drum 1 and the intermediary transfer belt 18 during the primary transfer, negatively affecting the image formation process. As a result, a toner image with traces of electrical discharge as illustrated by FIG. 10 was produced; in other words, the so-called "image with shark skin texture" was produced. The effects of this phenomenon were more conspicuous when a half tone image was produced.

SUMMARY OF THE INVENTION

The primary object of the present invention is to provide an image forming apparatus which can prevent the problem that the quality of a toner image is reduced after the toner image is transferred onto the intermediary transfer medium from the image bearing member.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Embodiment 1

Figure 1:
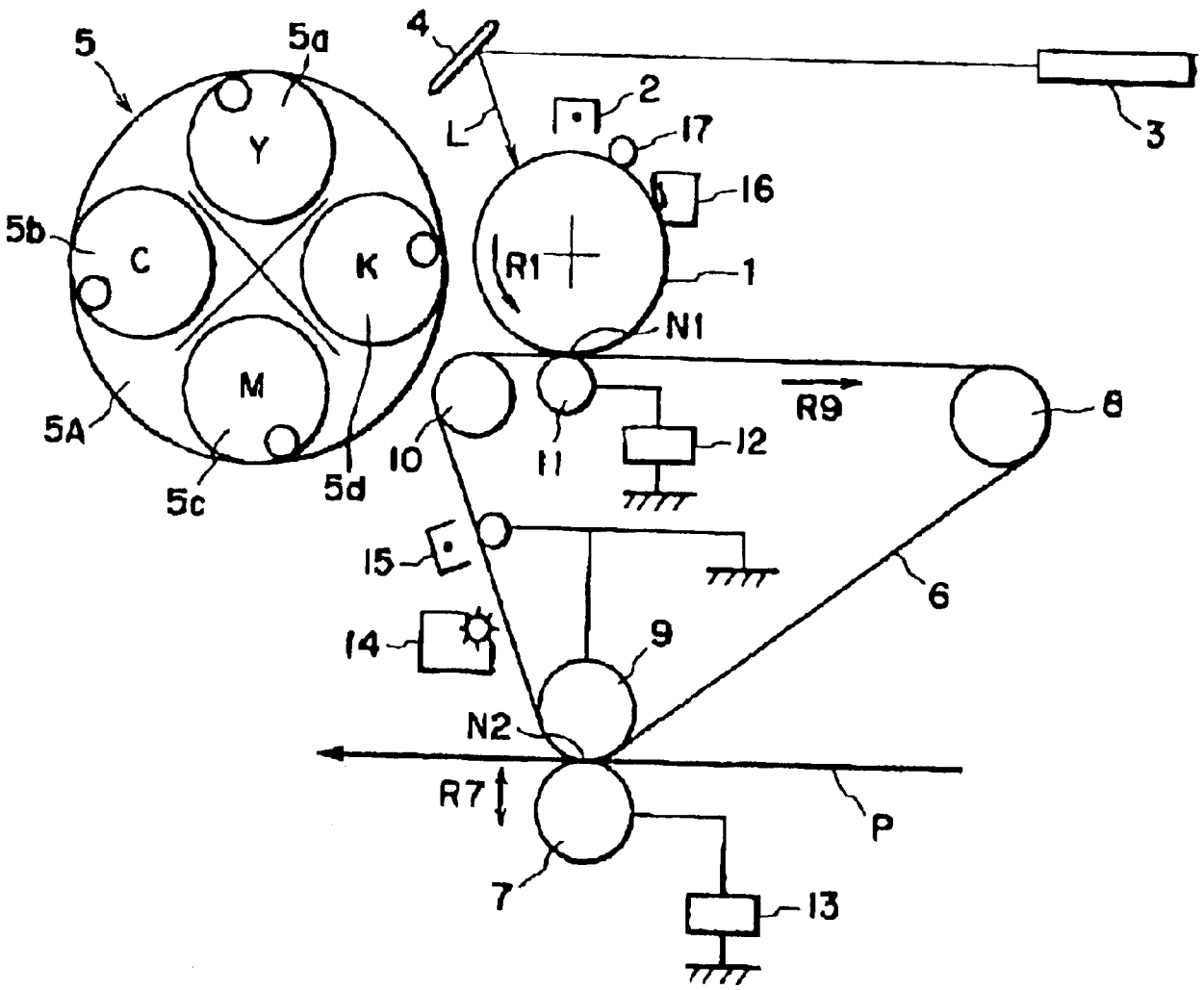
FIG. 1 is a schematic sectional view of the image forming apparatus in the first embodiment of the present invention.
Figure 9:
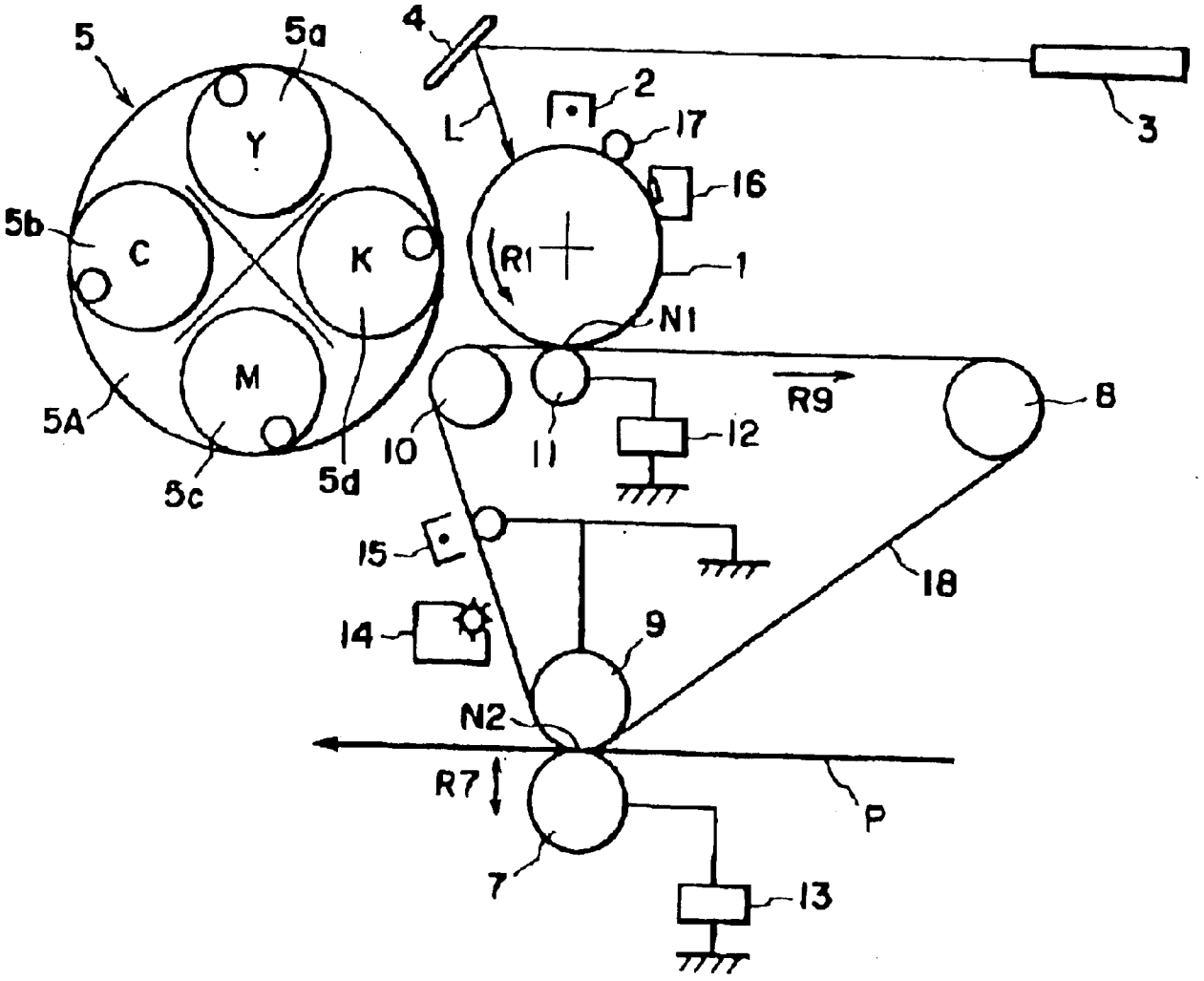
FIG. 9 is a schematic sectional view of a conventional image forming apparatus.
Figure 10:
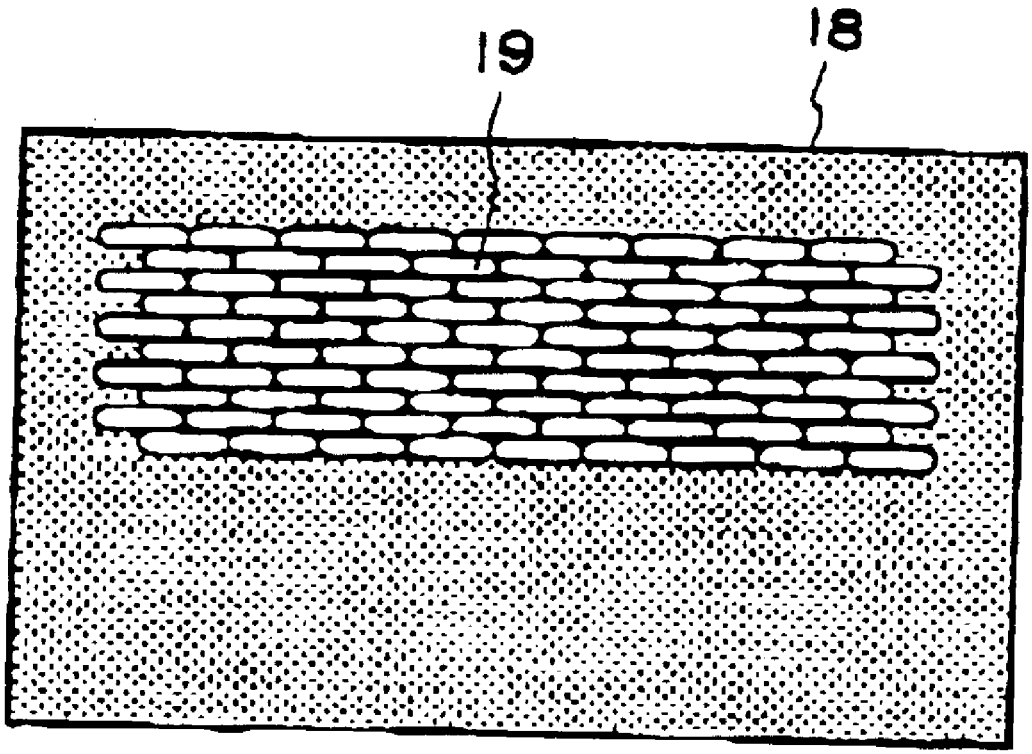
FIG. 10 is a schematic drawing which depicts the so-called "shark skin texture" having developed in an image on the intermediary transfer belt.

FIG. 1 is a schematic sectional view of the image forming apparatus in the first embodiment of the present invention, which is capable of forming color images. In the drawing, the same components as those in FIG. 9 are given the same referential characters.

A photosensitive drum 1 as an image bearing means (image bearing member) comprises a cylindrical base member formed of aluminum or the like material, and a photosensitive layer formed by coating photoconductive substance on the peripheral surface of the base member. As for photoconductive substances, OPC (organic photoconductor), A—Si (amorphous silicon), CdS (Cadmium Sulfate), Se (selenium), and the like can be used. The photosensitive drum 1 is rotatively driven by a driving means (unillustrated) at a predetermined process speed in the direction indicated by an arrow mark R1.

A charging apparatus 2 is a scorotron type charging device, which charges the peripheral surface of the photosensitive drum 1, with corona ions generated through corona discharge.

An exposing apparatus 3 exposes the peripheral surface of the photosensitive drum 1 charged with the charging apparatus 2, to the exposing light L modulated with the inputted image data. It comprises a laser driver, a laser diode, and a polygon mirror, which are not illustrated, a deflective mirror 4, and the like. More specifically, the laser beam is outputted from the laser diode in response to the inputted image data, deflected by the polygon mirror, deflective mirror, and the like, and exposes the peripheral surface of the photosensitive drum 1. As a result, an electrostatic latent image, which reflects the inputted image data, is formed.

A developing apparatus 5 develops the electrostatic latent image on the photosensitive drum 1. It comprises a yellow color developing device 5*a*, a cyan color developing device 5*b*, a magenta color developing device 5*c*, and a black color developing device 5*d*, which are mounted in a rotatively supported rotary 5A. The yellow color developing device 5*a*, cyan color developing device 5*b*, magenta color developing device 5*c*, and black color developing device 5*d* are moved by the rotation of the rotary 5A to the developing position, so that a specific developing device correspondent to the color to which the latent image on the peripheral surface of the photosensitive drum 1 is to be developed squarely faces the peripheral surface of the photosensitive drum 1. In the development station, toner is adhered to the latent image; the latent image is developed (visualized).

An intermediary transfer belt 6 as an intermediary transfer medium is stretched around a supporting means constituted of a driving roller 8, a counter roller 9 for the secondary transfer, and a tension roller 10, with the application of a tension of 4–8 kg, and is moved in the direction indicated by an arrow mark R9. In the primary transfer station N1 in which the intermediary transfer belt comes in contact with the photosensitive drum 1, a primary transfer roller 11 is disposed so that the intermediary transfer belt 6 is pinched between the primary transfer roller 11 and the photosensitive drum 1. The primary transfer roller 11 is connected to a high voltage power source 12. There is disposed a transfer roller 7 for the secondary transfer, opposing the counter roller 9 for secondary transfer, with the intermediary transfer belt 6 being positioned between the counter roller 9 and the transfer roller 7 for the secondary transfer. The point where the transfer roller 7 for the secondary transfer, counter roller 9, and intermediary transfer belt 6 meet constitutes the secondary transfer station N2. In order to carry out the secondary transfer, the transfer roller 7 for the secondary transfer is pressed upon the intermediary transfer belt 6 with a predetermined timing, with a transfer medium P being pinched between the transfer roller 7 for the secondary transfer and the intermediary transfer belt 6. After the secondary transfer, the transfer belt 7 for the secondary transfer is moved away from the intermediary transfer belt 6 in the direction indicated by an arrow mark R6. The transfer roller 7 for the secondary transfer is connected to a high voltage power source 13.

Along the outward facing surface of the intermediary transfer belt 6, a cleaning apparatus 14 and an electric charge discharging device 15 are disposed between the counter roller 9 for the secondary transfer and the tension roller 10. The cleaning apparatus 14 removes from the intermediary transfer belt 6 the toner which remains on the intermediary transfer belt 6 after the secondary transfer, and the discharging device 15 removes the electrical charge from the intermediary transfer belt 6.

Next, the image forming operation of the image forming apparatus configured as described above will be described.

First, the photosensitive drum 1 is uniformly charged by the charging apparatus 2, and an electrostatic latent image is formed on the peripheral surface of the photosensitive drum 1 by the exposing light L, or the laser beam from the exposing apparatus 3. The electrostatic latent image on the photosensitive drum 1 is developed by the pertinent developing device among the yellow color developing device 5*a*, cyan color developing device 5*b*, magenta color developing device 5*c*, and black color developing device 5*d*, and is transferred (primary transfer) onto the intermediary transfer belt 6 which is moved in contact with the photosensitive drum 1. This process is consecutively repeated for each primary color. As a result, four monochrome color images of different color are placed in layers on the intermediary transfer belt 6, creating a so-called color image.

Then, the transfer roller 7 for the secondary transfer is pressed upon the intermediary transfer belt 6, with the transfer medium P being pinched between the transfer roller 7 for the secondary transfer and the intermediary transfer belt 6. As a result, the color image is transferred all at once onto the transfer medium 9. After the secondary transfer, the transfer medium 9 is conveyed to a fixing apparatus (unillustrated), in which the color image is fixed to the surface of the transfer medium P by the application of heat and pressure. Thereafter, the transfer medium P is discharged from the apparatus.

Next, the above described primary and secondary transfer processes will be described in further detail.

(Primary Transfer Process)

When the photosensitive drum 1 is an OPC type photosensitive member, toner which is normally chargeable to positive polarity is used to develop an electrostatic latent image. Therefore, the polarity of the transfer bias applied to the primary transfer roller 11 by a high voltage power source 12 is positive.

The intermediary transfer belt 6 is desired to be formed of film of PVdf, nylon, PET, polycarbonate, or the like, which has a thickness of 10–200 μm and a volumetric resistivity of $10^{11}$–$10^{16}$ Ω·cm (resistivity has been adjusted as necessary). The primary transfer roller 11 is desired to be a roller with a volumetric resistivity of no more than $10^5$ Ω·cm. With the use of the intermediary transfer belt 6 formed of such thin film as described above, it is possible to generate several hundred to several thousand picofarads of static electricity in the primary transfer station N1 to flow stable transfer current.

(Second Transfer Process)

In the second transfer station N2, the counter roller 9 for the second transfer, which serves as the counter electrode, is grounded, and a transfer bias with the positive polarity is being applied to the second transfer roller 7 by a high voltage power source 13. In this state, the transfer medium P is passed through the second transfer station N2 to carry out the second transfer.

After the second transfer process, the post-second transfer residual toner, or the toner remaining on peripheral surface of intermediary transfer belt 6 after the second transfer, is removed by the cleaning apparatus 4. Then, the intermediary transfer belt 6 is cleared of electrical charge by the discharging device 15. Generally, in order to improve the discharging efficiency of the discharging device 15, an electrode is disposed in contact with the intermediary transfer belt 6, on the side opposite to the discharging device 15. Meanwhile, the post-primary transfer residual toner, or the toner remaining on the photosensitive drum 1 after the primary transfer, is recovered by a photosensitive drum cleaner 16 so that the photosensitive drum 1 can be initialized for the following image forming operation, by a charge removing roller 17.

Further, in order to prolong the service life of the intermediary transfer belt 6, as well as to prevent the toner particles of the toner image from being scattered, the elastic layer, as the base layer, of the intermediary transfer belt 6 may be provided with a surface layer formed of fluorinated resin or the like with a high volumetric resistivity.

Figure 2:
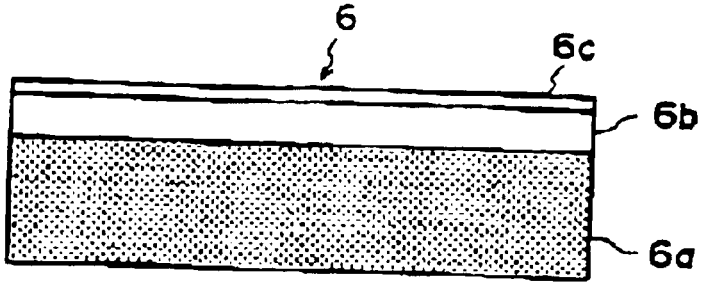
FIG. 2 is a schematic sectional view of the intermediary transfer belt of the image forming apparatus in the first embodiment of the present invention.

Referring to FIG. 2, the intermediary transfer belt 6 in this embodiment comprises a rubber layer 6*a* as the elastic layer, a high electrical resistance layer 6*b*, and a 3 μm thick charge releasing layer 6*c*, which are layered in this order from the bottom. The volumetric resistivity of the charge releasing layer 6*c* is smaller than that of the high resistance layer 6*b*.

The research conducted by the inventors of the present invention in regard to the formation of a low quality image negatively affected by the shark skin-like texture effected by electrical discharge revealed the following.

(1) The shark skin-like texture is liable to be effected in an environment with low humidity.

(2) The shark skin-like texture is liable to be effected approximately in proportion to the voltage level of the primary transfer bias. The shark skin-like texture is more liable to occur when a toner image of the fourth color is transferred (primary transfer), because the intermediary transfer belt 6 is charged up each time the primary transfer process is carried out, making it necessary to increase the primary transfer voltage for the following color toner image.

(3) The shark skin-like texture is less likely to occur approximately in reverse proportion to the surface resistance of the intermediary transfer belt.

Figure 3:
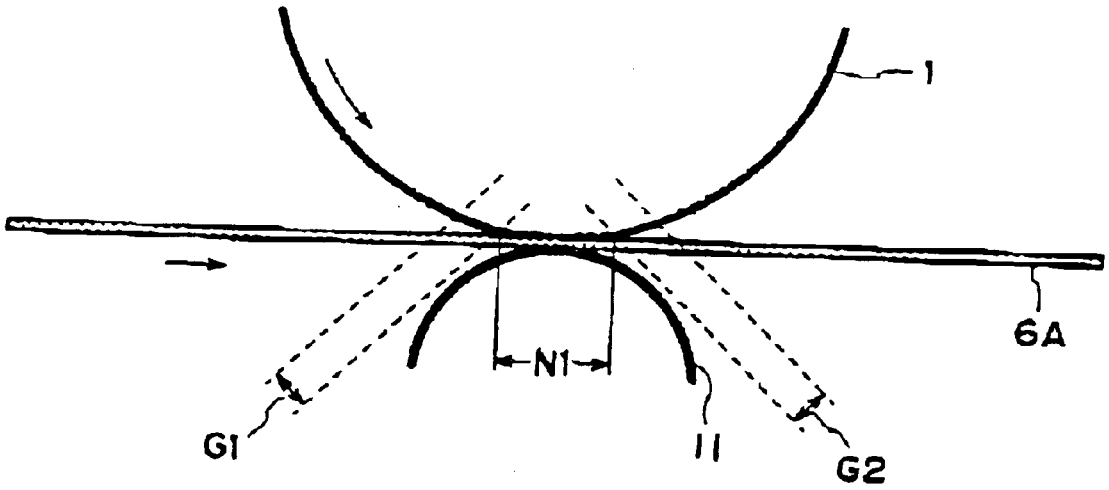
FIG. 3 is a schematic drawing which depicts the process through which an image with "shark skin-like" texture is produced.

Based on the above discoveries, it is conceivable that the cause of the sharp skin-like texture is traceable to the abnormal electrical discharge which occurs adjacent to the primary transfer station N1 between the photosensitive drum 1 and the primary transfer roller 11, more specifically, through the microscopic gaps G1 and G2 between the intermediary transfer belt 6 and the photosensitive drum 1 illustrated in FIG. 3.

Figure 4:
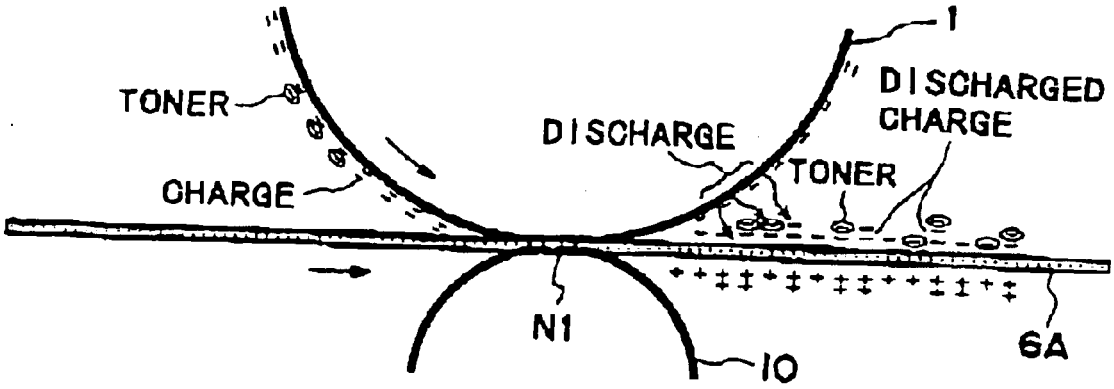
FIG. 4 is a schematic drawing which shows the electrical charge distribution on an intermediary transfer belt with no electrical charge releasing layer.

FIG. 4 is a schematic drawing which depicts the electrical charge distribution across the peripheral surface of an intermediary transfer belt 6A, in the microscopic gaps G1 and G2 between the intermediary transfer belt 6A and the photosensitive drum 1. The intermediary transfer belt 6A is not provided with the charge releasing layer 6*c* which is provided on the high resistance layer 6*b* of the intermediary transfer belt 6. In this case, if the strength of the electrical field between the surface of the intermediary transfer belt 6A and the peripheral surface of the photosensitive drum 1 is excessive, the electrical discharge occurs through the gaps.

Figure 5:
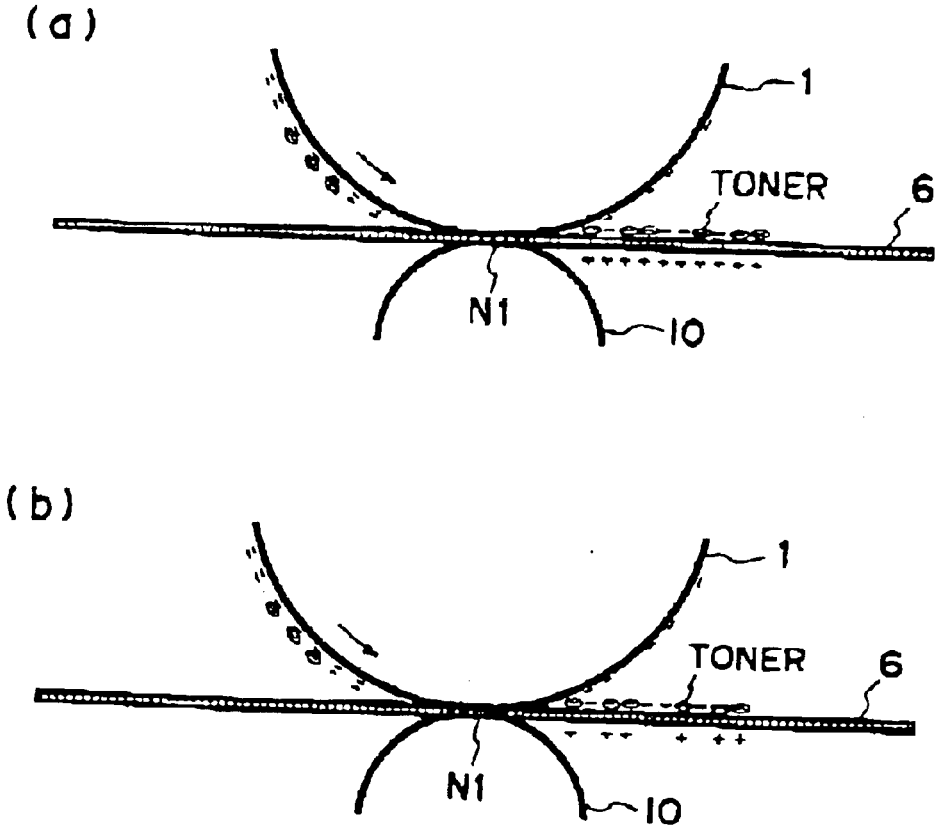
FIG. 5 is a schematic drawing which shows the electrical charge distribution on the intermediary transfer belt of the image forming apparatus, which is provided with an electrical charge releasing layer, (a) depicting a case in which the layer has a proper thickness, and (b) depicting a case in which the layer is thicker.

On the other hand, if the charge releasing layer 6*c* is provided on the high resistance layer 6*b* as in the case of the intermediary transfer belt 6 in this embodiment illustrated by FIG. 5, (a), the electrical charge on the intermediary transfer belt 6 horizontally transfers by a proper amount through the charge releasing layer 6*c* (in the direction in which intermediary transfer belt 6 is moved). Therefore, the electrical field between the intermediary transfer belt 6 and the photosensitive drum 1, in the microscopic gaps G1 and G2, is reduced in strength. Consequently, the electrical discharge does not occur through the gaps.

Referring to FIG. 5, (b), if the charge releasing layer 6*c* is given an excessive amount of charge releasing capacity (charge releasing layer 6*b* is thickened), the electrical charge which is to transfer from the peripheral surface of the photosensitive drum 1 to the intermediary transfer belt 6 during the primary transfer is almost completely lost; in particular, the charge across the portions of the peripheral surface of photosensitive drum 1 correspondent to the colorless portions (portions not covered with toner) of the color image is almost completely lost. Therefore, the wall of the electric charge which laterally supports the toner image on the intermediary transfer belt 6 is lost; in other words, the force which keeps the toner adhered to the intermediary transfer belt 6 is lost, making it easier for the toner particles of the toner image to be scattered at the points where the intermediary transfer belt 6 is bent.

In a test in which the charge releasing layer was made to be 20 μm, the toner particles were scattered from the toner image during the primary transfer. Therefore, an additional research was done by the inventors of the present invention while paying attention to the relationship between the charge releasing layer 6*c* and the quality of the image (toner image to be transferred onto intermediary transfer belt 6), obtaining the following results given in Table 1.

TABLE 1

| Thickness of discharging layer | None | 1 μm | 3 μm | 5 μm | 10 μm | 20 μm |
|---|---|---|---|---|---|---|
| Image | N/G | G/G | G/G | G/G | G/N | G/N |

Shark-skin like texture/scattering
G: Did not occur
N: Occurred

As is evident from Table 1, when the thickness of the charge releasing layer 6*c* exceeded 5 μm, the toner particles were scattered from the toner image. This was thought to be because, as the thickness of the charge releasing layer 6*c* was thickened, the effects of the high resistance layer 6*b* upon the surface of the intermediary transfer belt 6 failed to manifest; in other words, the intermediary transfer belt 6 failed to hold the charge on its surface, allowing the toner particles to scatter from the toner image.

As described above, in this embodiment, a charge releasing layer 6c which had a thickness of 1–5 μm and was lower in volumetric resistivity than the high resistance layer 6b, was provided on the high resistance layer 6b, so that the toner particles did not scatter from the toner image. Therefore, the shark skin-like texture did not occur.

The rubber layer 6a of the intermediary transfer belt 6 in this embodiment comprised a mesh of polyester fiber and epichlorohydrin rubber. More specifically, the mesh had a pitch of 0.5 mm, and the polyester fiber had a weight of 75 denier. The epichlorohydrin rubber had been adjusted in volumetric resistivity to $10^6$ Ω·m, and was applied to both the top and bottom sides of the mesh. The overall thickness of the intermediary transfer belt 6 was 0.7 mm. Instead of the epichlorohydrin rubber, NBR (nitryl butadiene rubber), CR (chlorophene rubber), or the like may be employed as the material for the rubber layer.

The high resistance layer 6b was formed of a mixture between a material belonging to a urethane group, and a fluorinated material, the volumetric resistivity of which had been adjusted to $10^{14}$ Ω·cm. In manufacturing the intermediary transfer belt 6, the mixture was dissolved in an organic solvent such as ethanol, and the solution was sprayed on the surface of the rubber layer 6a. The thickness of the high resistance layer 6b was made to be approximately 30 μm by controlling the number of times the rubber layer 6b was coated with the solution.

Similarly, the charge releasing layer 6c was formed of a mixture between a material belonging to urethane group, and a fluorinated material. The volumetric resistivity of the mixture as the material for the charge releasing layer 6b was adjusted to approximately $10^{13}$ Ω·cm by using a urethane group material having a smaller volumetric resistivity than the urethane group material for the high resistance layer 6b, as the material for the charge releasing layer 6c.

The fluorinated material was mixed into the urethane group material for the charge releasing layer 6c, or the outermost layer of the intermediary transfer belt 6, to improve the intermediary transfer belt 6 in terms of toner release, so that the post-second transfer residual toner could be easily removed.

This mixture was dissolved in an organic solvent, and the solvent was sprayed on the high resistance layer 6b. The thickness of the charge releasing layer 6c was made to be approximately 3 μm by adjusting the number of times the solution was coated.

The values of the volumetric resistivities of the aforementioned high resistance layer 6b and charge releasing layer 6c of the intermediary transfer belt 6 were the values obtained through the following measurement.

<Measuring Devices>

Resistance Meter: Super High Resistance Meter R8340A (Advantest Co.)

Sample Chamber: Super High Resistance Measurement Test Material Chamber TR42 (Advantest Co.; primary electrode diameter: 50 mm; guard ring internal diameter: 70 mm; and guard ring external diameter: 80 mm)

<Sample>

The materials for the charge releasing layer and the high resistance layer were coated on a sheet of aluminum to a thickness of 15–40 μm, and the coated aluminum sheet was cut into square pieces with an edge length of 10 cm to use as measurement sample.

<Measurement Condition>

Temperature: 22–23° C.

Humidity: 50–60%

The measurement samples were left in the ambiance with a temperature of 22–23° C. and a humidity of 50–60% for no less than 24 hours.

Applied Voltage: 100 V

When impossible to measure due to the limiter (300 mA), a voltage of 1 V was applied.

Measurement Mode: program mode 5 (discharge: 10 seconds; charge: 30 seconds; and measurement: 30 seconds)

The research by the inventors of the present invention revealed that the volumetric resistivity of the high resistance layer 6b of the intermediary transfer belt 6 is desired to be in a range of $10^{11}$–$10^{15}$ Ω·cm.

If the volumetric resistivity is no more than $10^{11}$ Ω·cm, the aforementioned scattering of the toner occurred regardless of the thickness and volumetric resistivity of the charge releasing layer 6b. If the volumetric resistivity is no less than $10^{15}$ Ω·cm, the aforementioned shark skin-like texture occurred regardless of the thickness and volumetric resistivity of the charge releasing layer 6b.

Also, it became evident that the volumetric resistivity of the charge releasing layer 6c is desired to be in a range of $10^{10}$–$10^{14}$ Ω·cm.

If the volumetric resistivity is no more than $10^{10}$ Ω·cm, the aforementioned scattering of the toner occurred regardless of the thickness of the charge releasing layer 6c, and if the volumetric resistivity is no less than $10^{14}$ Ω·cm, the aforementioned shark skin-like texture occurred regardless of the thickness of the charge releasing layer 6c.

In some tests, fluorine particles, silica particles, or the like were dispersed in the high resistance layer 6b and charge releasing layer 6c of the intermediary transfer belt 6 to adjust the coarseness and friction factor of the surface of the intermediary transfer belt 6. Also in these tests, the volumetric resistitivies were measured with the use of the above described method. The results were that when the volumetric resistivity of the charge releasing layer 6c was smaller than that of the high resistance layer 6b, the occurrence of the shark skin-like texture could be prevented.

Embodiment 2

Figure 6:
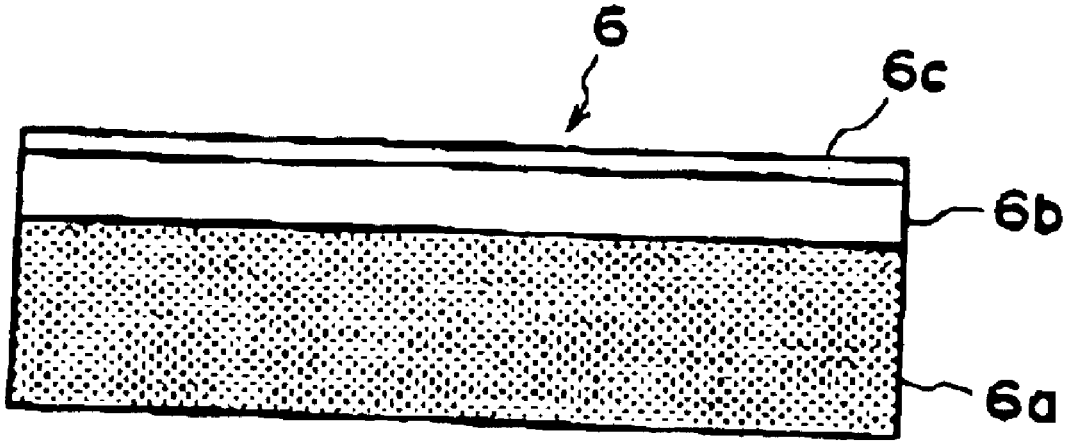
FIG. 6 is a sectional view of the intermediary transfer belt of the image forming apparatus in the second embodiment of the present invention.

FIG. 6 is a schematic section of the intermediary transfer belt 6 employed in the image forming apparatus in this embodiment. Since the configuration of this image forming apparatus is the same as that of the image forming apparatus illustrated in FIG. 1, except for the structure of the intermediary transfer belt 6, the description of the structure and image forming operation of this image forming apparatus will be omitted here.

Referring to FIG. 6, the intermediary transfer belt 6 employed in the image forming apparatus in this embodiment comprised a rubber layer 6a, a high resistance layer 6b laid on the surface of the rubber layer 6b, and a 4 μm thick charge releasing layer 6c laid on the surface of the high resistance layer 6b.

In this embodiment, the charge releasing layer 6c was composed of binder, which was the same material as that for the high resistance layer 6b, and particles dispersed in the binder. The volumetric resistivity of the particles was smaller than that of the material of the high resistance layer 6b.

Also in the case of this embodiment, in which the compound material composed of the material for the high resistance layer 6b and the particles with low electrical resistance was used as the material for the charge releasing layer 6c, it was possible to prevent the problem that abnormal electrical discharge occurs adjacent to the primary transfer station N1.

Further, also in this embodiment, research was conducted regarding the relationship between the charge releasing layer 6c and the quality of the image (toner image to be transferred (primary transfer) as in the first embodiment. The results are given in Table 2.

TABLE 2

| Thickness of discharging layer | None | 1 μm | 3 μm | 5 μm | 10 μm |
|---|---|---|---|---|---|
| Image | N/G | G/G | G/G | G/G | G/N |

Shark-skin like texture/scattering
G: Did not occur
N: Occurred

As is evident from Table 2, even when substance with low electrical resistance was dispersed in the material for the charge releasing layer 6*c*, the scattering of the toner particles occurred when the thickness of the charge releasing layer 6*c* exceeded 5 μm.

This is thought to occur because, as the thickness of the charge releasing layer 6*c* increases, the effects of the high resistance layer 6*b* (capacity of high resistance layer 6*b* in terms of holding toner image and electrical charge to intermediary transfer belt 6) reduces, making it difficult for the surface of the intermediary transfer belt 6 to retain the electrical charge which forms a wall of electrical charge which holds the toner image. As a result, the toner particles are scattered from the toner image.

As described above, in this embodiment, the volumetric resistivity of the charge releasing layer 6*c* was made smaller than that of the high resistance layer 6*b*, and a 1–5 μm thick charge releasing layer 6*c* was provided on the high resistance layer 6*b*. As a result, the scattering of the toner particles from the toner image was prevented; an image suffering from the shark skin-like textured was not produced.

The rubber layer 6*a* of the intermediary transfer belt 6 in this embodiment was formed of the same material as that in the first embodiment. Also, the high resistance layer 6*b* was formed of the same material as that in the first embodiment, which was spray coated on the surface of the rubber layer 6*a* to a thickness of approximately 30 μm.

As for the material for the charge releasing layer 6*c*, the same material as that for the high resistance layer 6*b* was used as binder, and particles of PVdF (polyvinylidene fluoride) with a volumetric resistivity of $10^{13}$ Ω·cm were dispersed in the binder by 40% by weight. The thus composed material was dissolved in an organic solvent such as ethanol, and the solvent was spray coated on the surface of the high resistance layer 6*b* while controlling the number of times the solution was coated so that the thickness of the charge releasing layer 6*c* became approximately 4 μm.

Embodiment 3

Figure 7:
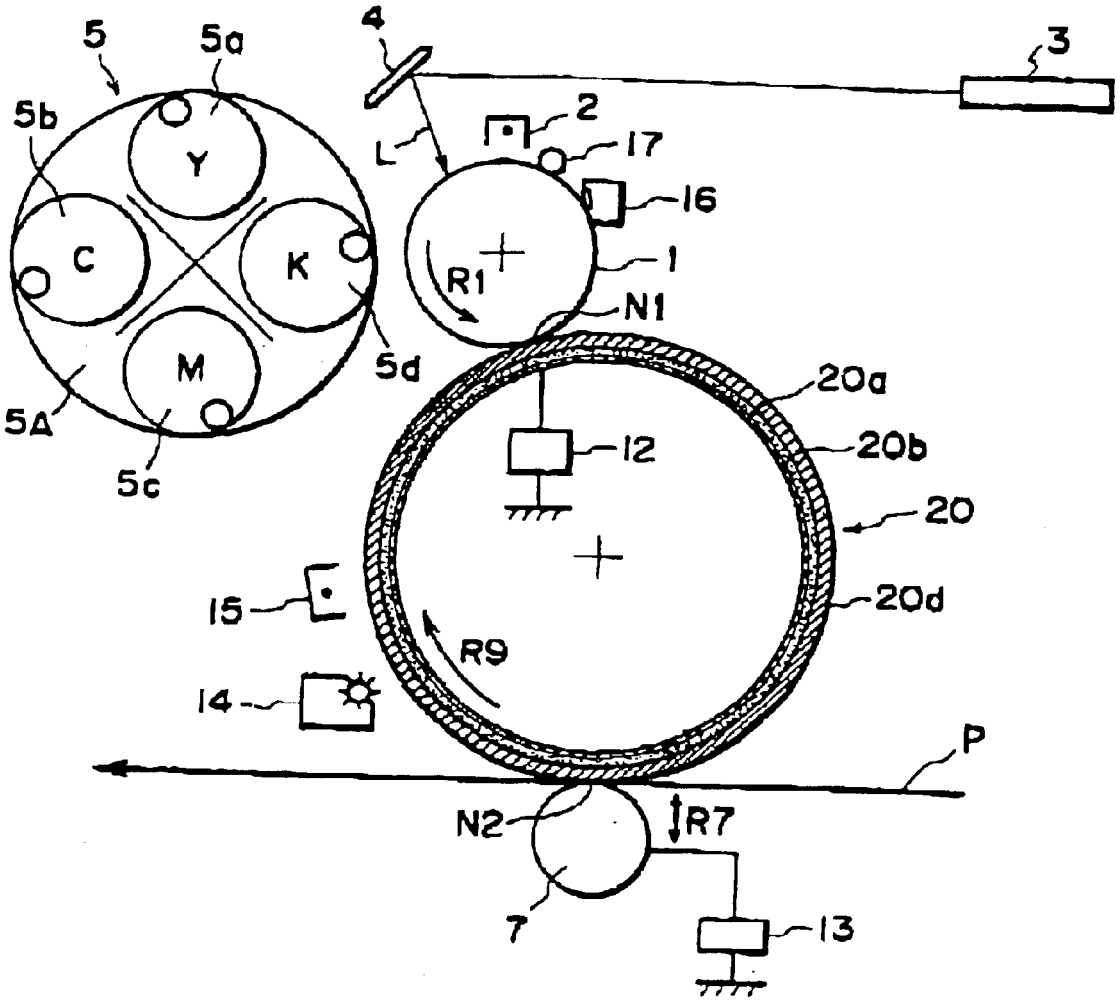
FIG. 7 is a schematic sectional view of the image forming apparatus in the third embodiment of the present invention.

FIG. 7 is a schematic sectional view of the image forming apparatus in this embodiment. In the drawings, the same members as those in the image forming apparatus illustrated in FIG. 1 are given the same referential characters as those in FIG. 1 so that duplication of the same description can be avoided.

The image forming apparatus in this embodiment is such an image forming apparatus that uses an intermediary transfer drum 20 as the intermediary transfer member. Except for the structure of the intermediary transfer member, the configuration of the image forming apparatus is the same as that of the apparatus in FIG. 1, and therefore, its description will be omitted here.

As described above, the visual images developed on the photosensitive drum 1 from the electrostatic latent images on the photosensitive drum 1 by the yellow color developing device 5*a*, cyan color developing device 5*b*, magenta color developing device 5*c*, and black color developing device 5*d* are consecutively transferred (primary transfer) onto the intermediary transfer drum 20. More specifically, the intermediary transfer drum 20 is being rotated in the direction indicated by an arrow mark R9, and as the primary transfer bias is applied to the metallic cylinder 20*a*, that is, the base member, of the intermediary transfer drum 20 by a high voltage power source 12, the monochrome images are consecutively layered onto the intermediary transfer drum 20, in the primary transfer station N1, as they are developed. After all the monochrome images are transferred onto the intermediary transfer drum 20, they are transferred all at once onto a transfer medium P in the secondary transfer station N2. After the secondary transfer, the post-secondary transfer residual toner on the intermediary transfer drum 20, that is, the toner remaining on the intermediary transfer drum 20 after the secondary transfer, is removed by a cleaning apparatus 14, and the surface charge of the intermediary transfer drum 20 is removed by a charge discharging device 15.

Figure 8:
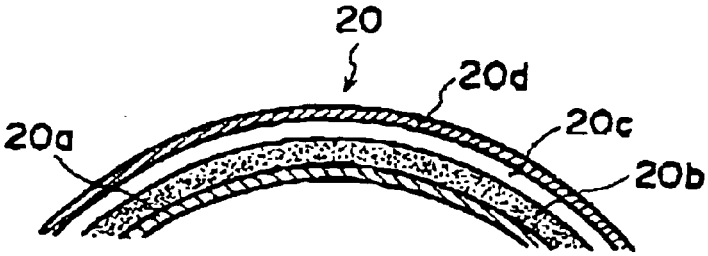
FIG. 8 is a schematic sectional view of the intermediary transfer drum of the image forming apparatus in the third embodiment of the present invention.

Referring to FIG. 8, the intermediary transfer drum 20 comprises: the metallic cylinder 20*a*; an elastic layer 20*b* which is formed of rubber or the like material, and placed on the peripheral surface of the metallic cylinder 20*a*; a high electric resistance layer 20*c* placed on the surface of the elastic layer 20*b*; and a charge releasing layer 20*d* placed on the surface of the high resistance layer 20*c*. The volumetric resistivity of the charge releasing layer 20*d* is smaller than that of the high resistance layer 20*c*.

Even when the intermediary transfer drum 20 was used as the intermediary transfer member, the provision of the high resistance layer 20*c* was effective to prevent the toner particles from scattering from the toner image. However, abnormal electrical discharge occurred in the primary transfer station N1, resulting in an image suffering from the aforementioned shark skin-like texture.

On the other hand, when it was made easier for the electrical charge on the peripheral surface of the intermediary transfer drum 20 to move in the horizontal direction (rotational direction of intermediary transfer drum 20), by providing the charge releasing layer 20*d* on the high resistance layer 20*c*, the electrical charge on the peripheral surface of the intermediary transfer drum 20 was uniformly distributed, preventing the formation of images suffering from the shark skin-like texture.

Further, when research was done regarding the relationship between the charge releasing layer 20*d* and the quality of the image (toner image to be transferred onto intermediary transfer drum 20) as they were regarding those in the first and second embodiments, the results shown in Table 3 given below were obtained.

TABLE 3

| Thickness of discharging layer | None | 1 μm | 3 μm | 5 μm | 10 μm | 15 μm |
|---|---|---|---|---|---|---|
| Image | N/G | G/G | G/G | G/G | G/N | G/N |

Shark-skin like texture/scattering
G: Did not occur
N: Occurred

As is evident from Table 3, when the thickness of the charge releasing layer 20*d* of the intermediary transfer drum 20 exceeded 5 μm, the toner particles were scattered from the toner image.

It was also thought in the course of this research that, as the thickness of the charge releasing layer 20*d* was increased, the effects of the high resistance layer 20*c* upon the surface properties of the intermediary transfer drum 20 was reduced, making it difficult for the surface of the intermediary transfer drum 20 to retain the electrical charge, which resulted in the scattering of the toner particles from the toner image.

As described above, in this embodiment, the volumetric resistivity of the charge releasing layer 20*d* was made smaller than that of the high resistance layer 20*c*, and a charge releasing layer 20*d* with a thickness of 1–5 μm was provided on the surface of the high resistance layer 20*c* to prevent the scattering of the toner particles from the toner image. As a result, the formation of an image suffering from the shark skin-like texture could be prevented.

Also in this embodiment, an aluminum cylinder with a diameter of approximately 50 mm was employed as the metallic cylinder 20*a* for the intermediary transfer drum 20. As for the material for the elastic layer 20*b*, NBR, the volumetric resistivity of which had been adjusted to $10^5$ Ω·cm by dispersing carbon in it, was used, and this material was coated on the peripheral surface of the metallic cylinder 20*a*. The thickness of the elastic layer 20*a* was adjusted to approximately 3.0 mm by polishing.

As for the materials for the high resistance layer 20*c* and charge releasing layer 20*d*, the same materials as those used in the first and second embodiments were used. They were spray coated while controlling the number of times the materials were coated so that the thicknesses of the high resistance layer 20*c* and charge releasing layer 20*d* became approximately 20 μm and 3 μm, respectively.

As for the material for the charge releasing layer 20*d*, a material in which particles with low electrical resistivity was used. Therefore, even when the thickness of the charge releasing layer 20*d* was in a range of 1–5 μm, the scattering of the toner particles from the toner image did not occur, and also it was possible to prevent the formation of an image suffering from the shark skin-like texture.

While the invention has been described with reference to the above described first to third embodiments of the present invention, it is not confined to the details set forth, and this application is intended to cover such modifications or changes as may come within the purposes of the improvements or the scope of the following claims.

For example, the present invention is also applicable to such an image forming apparatus that comprises four photosensitive drums, that is, one photosensitive drum for each of four primary colors: yellow, magenta, cyan, and black, in which the toner image formed on each photosensitive drum is electrostatically and consecutively transferred (primary transfer) in layers onto an intermediary transfer belt (or drum); and the toner images on the intermediary transfer belt (or drum) are transferred all at once onto a transfer medium.

What is claimed is:

1. An image forming apparatus comprising:

image bearing means for bearing a toner image;

an intermediary transfer member, wherein the toner image is electrostatically transferred from said image bearing means onto said intermediary transfer member, and then transferred from said intermediary transfer member onto a transfer material;

wherein said intermediary transfer member includes a first layer, a second layer on said first layer and a third layer on said second layer, wherein said third layer receives the toner image from said image bearing means, and wherein a volume resistivity of said first layer is smaller than that of said third layer, a volume resistivity of said third layer is smaller than that of said second layer, and the thickness of said third layer is 1 to 5 microns.

2. An apparatus according to claim 1, wherein the volume resistivity of said second layer is $10^{11}$ to $10^{15}$ Ohm.cm.

3. An apparatus according to claim 1, wherein said second layer has a thickness larger than that of said third layer.

4. An apparatus according to claim 1, wherein a plurality of the toner images are transferred onto said intermediary member so that an overlaid toner image is formed thereon, and the overlaid images are transferred from said intermediary transfer member onto the transfer material.

5. An apparatus according to claim 4, wherein said image bearing means is provided with an image bearing member capable of bearing different color toner images.

6. An apparatus according to claim 4, wherein said image bearing means is provided with a plurality of image bearing members for bearing different color images, respectively.

7. An apparatus according to claim 1, further comprising transfer means for electrostatically transferring the toner image from said image bearing means onto said intermediary transfer member, wherein said transfer means applied a voltage to such a side of said intermediary transfer member as is opposite from a side thereof for receiving the toner image.

8. An apparatus according to claim 7, wherein the voltage has a polarity opposite from a regular charging polarity of the toner.

9. An apparatus according to claim 8, wherein said transfer means is provided with a voltage source for supplying the voltage.

10. An apparatus according to claim 9, wherein said transfer means is provided with a roller contactable to such a side of said intermediary transfer member as is opposite from a side thereof for receiving the toner image.

11. An apparatus according to claim 1, further comprising charging means for charging a surface of said image bearing means to a polarity which is the same as a regular charging polarity of the toner.

12. An apparatus according to claim 1, wherein said first layer is elastic.

13. An apparatus according to claim 12, wherein said first layer is a rubber layer.

14. An apparatus according to claim 1, wherein said intermediary transfer member is in the form of a belt.

15. An apparatus according to claim 14, further comprising supporting means for supporting said intermediary transfer member.

16. An apparatus according to claim 15, wherein said supporting means is provided with a plurality of rollers.

17. An apparatus according to claim 1, further comprising transfer means for applying a voltage to said first layer to electrostatically transfer the toner image to said intermediary transfer member from said image bearing member.

18. An apparatus according to claim 1, wherein said first layer is coated with said second layer.

19. An apparatus according to claim 1, wherein said second layer is coated with said third layer.

20. An apparatus according to claim 1, wherein said first layer is coated with said second layer, and said second layer is coated with said third layer.

21. An apparatus according to claim 1, wherein said first layer is an elastic layer.

22. An apparatus according to claim 21, wherein said first layer is a rubber layer.

23. An apparatus according to claim 1, wherein the volume resistivity of said third layer is $10^{10}$ to $10^{14}$ Ohm.cm.

24. An intermediary transfer member onto which a toner image is electrostatically transferred from image bearing means, wherein the toner image on said intermediary transfer member is transferred onto a transfer material, said intermediary transfer member comprising:

a first layer;

a second layer, provided on said first layer; and a third layer, provided on said second layer, for receiving the toner image from the image bearing means, wherein a volume resistivity of said first layer is smaller than that of said third layer, a volume resistivity of said third layer is smaller than that of said second layer, and the thickness of said third layer is 1 to 5 microns.

25. An intermediary transfer member according to claim 24, wherein the volume resistivity of said second layer is $10^{11}$ to $10^{15}$ Ohm.cm.

26. An intermediary transfer member according to claim 24, wherein said second layer has a thickness larger than that of said third layer.

27. An intermediary transfer member according to claim 24, wherein a plurality of the toner images are transferred onto said intermediary transfer member so that an overlaid toner image is formed thereon, wherein overlaid toner images are transferred onto the transfer material and said intermediate transfer member.

28. An intermediary transfer member according to claim 24, wherein said intermediary transfer member is in the form of a belt.

29. An apparatus according to claim 24, wherein said first layer is coated with said second layer.

30. An apparatus according to claim 24, wherein said second layer is coated with said third layer.

31. An apparatus according to claim 24, wherein said first layer is coated with said second layer, and said second layer is coated with said third layer.

32. An intermediary transfer member according to claim 24, wherein the volume resistivity of said third layer is $10^{10}$ to $10^{14}$ Ohm.cm.

33. An image forming apparatus comprising:

image bearing means for bearing a toner image;

an intermediary transfer member, wherein the toner image is electrostatically transferred from said image bearing means onto said intermediary transfer member, and then transferred from said intermediary transfer member onto a transfer material, wherein said intermediary transfer member includes a first layer and a second layer, wherein said second layer receives the toner image from said image bearing means, wherein said first layer is integrally coated with said second layer, wherein said second layer has a volume resistivity smaller than that of said first layer, and the thickness of said second layer is 1 to 5 microns.

34. An apparatus according to claim 33, wherein the volume resistivity of said first layer is $10^{11}$ to $10^{15}$ Ohm.cm.

35. An apparatus according to claim 33, wherein said first layer has a thickness larger than that of said second layer.

36. An apparatus according to claim 33, wherein a plurality of the toner images are transferred onto said intermediary transfer member so that an overlaid toner image is formed thereon, and the overlaid images are transferred from said intermediary transfer member onto the transfer material.

37. An apparatus according to claim 36, wherein said image bearing means is provided with an image bearing member capable of bearing different color toner images.

38. An apparatus according to claim 36, wherein said image bearing means is provided with a plurality of image bearing members for bearing different color toner images, respectively.

39. An apparatus according to claim 33, further comprising transfer means for electrostatically transferring the toner image from said image bearing means onto said intermediary transfer member, wherein said transfer means applied a voltage to such a side of said intermediary transfer member as is opposite from a side thereof for receiving the toner image.

40. An apparatus according to claim 39, wherein the voltage has a polarity opposite from a regular charging polarity of the toner.

41. An apparatus according to claim 40, wherein said transfer means is provided with a voltage source for supplying the voltage.

42. An apparatus according to claim 41, wherein said transfer means is provided with a roller contactable to such a side of said intermediary transfer member as is opposite from a side thereof for receiving the toner image.

43. An apparatus according to claims 33, further comprising charging means for charging a surface of said image bearing means to a polarity which is the same as a regular charging polarity of the toner.

44. An apparatus according to claim 33, wherein said intermediary transfer member is provided with a base layer, and wherein said first layer is provided on said base layer.

45. An apparatus according to claim 44, wherein said base layer is elastic.

46. An apparatus according to claim 45, wherein said base layer is a rubber layer.

47. An apparatus according to claim 33, wherein said intermediary transfer member is in the form of a belt.

48. An apparatus according to claim 47, further comprising supporting means for supporting said intermediary transfer member.

49. An apparatus according to claim 48, wherein said supporting means is provided with a plurality of rollers.

50. An apparatus according to claim 33, wherein the volume resistivity of said second layer is $10^{10}$ to $10^{14}$ Ohm.cm.

51. An intermediary transfer member onto which a toner image is electrostatically transferred from image bearing means, wherein the toner image on said intermediary transfer member is transferred onto a transfer material, said intermediary transfer member comprising:

a first layer; and a second layer for receiving the toner image from said image bearing means, wherein said first layer is integrally coated with said second layer, wherein said second layer has a volume resistivity smaller than that of said first layer, and the thickness of said second layer is 1 to 5 microns.

52. An intermediary transfer member according to claim 51, wherein the volume resistivity of said first layer is $10^{11}$ to $10^{15}$ Ohm.cm.

53. An intermediary transfer member according to claim 51, wherein said first layer has a thickness larger than that of said second layer.

54. An intermediary transfer member according to claim 51, wherein a plurality of the toner images are transferred onto said intermediary transfer member so that an overlaid toner image is formed thereon, wherein overlaid toner images are transferred onto the transfer material and said intermediate transfer member.

55. An intermediary transfer member according to claim 51, wherein said intermediary transfer member is in the form of a belt.

56. An apparatus according to claim 51, wherein said intermediary transfer member is provided with a base layer, and said base layer is coated with said first layer.

57. An apparatus according to claim 56, wherein said base layer is an elastic layer.

58. An apparatus according to claim 57, wherein said base layer is a rubber layer.

59. An intermediary transfer member according to claim 51, wherein the volume resistivity of said third layer is $10^{10}$ to $10^{14}$ Ohm.cm.

* * * * *

UNITED STATES PATENT AND TRADEMARK OFFICE

CERTIFICATE OF CORRECTION

PATENT NO. : 6,801,741 B2
DATED : October 5, 2004
INVENTOR(S) : Naoki Enomoto et al.

It is certified that error appears in the above-identified patent and that said Letters Patent is hereby corrected as shown below:

Title page, Item [63] and Column 1, line 1,
Title, "WITH" should read -- WITH THREE LAYER --.

Title page,
Item [30], Foreign Application Priority Data, "9-158202" should read -- 10-158202 --.
Item [*] Notice, insert:
-- This patent issued on a continued prosecution application filed under 37 CFR 1.53(d), and is subject to the twenty year patent term provision of 35 U.S.C. 154 (a)(2). --.

Column 7,
Line 15, "(chlorophene" should read -- (chloroprene --.

Column 11,
Line 17, "$10^5$" should read -- $10^6$ --.

Column 12,
Line 15, "applied" should read -- applies --.

Column 13,
Line 61, "applied" should read -- applies --.

Column 14,
Lines 56, 59 and 61, "apparatus" should read -- intermediary transfer member --.

Signed and Sealed this

First Day of February, 2005

JON W. DUDAS
*Director of the United States Patent and Trademark Office*